US005086674A

United States Patent [19]

Her

[11] Patent Number: 5,086,674

[45] Date of Patent: Feb. 11, 1992

[54] MULTI-PURPOSE HAND TOOL

[75] Inventor: Jern-Shong Her, Changhua City, Taiwan

[73] Assignee: Yu Chou Enterprise Co., Ltd., Changhua City, Taiwan

[21] Appl. No.: 693,468

[22] Filed: Apr. 30, 1991

[51] Int. Cl.[5] ..... B25B 13/00

[52] U.S. Cl. ..... 81/124.4; 81/124.3; 81/DIG. 7; 7/138

[58] Field of Search ..... 81/124.4, 124.6, 437, 81/124.3, DIG. 7; 7/138, 170

[56] References Cited

U.S. PATENT DOCUMENTS 226,582 4/1880 Miller ..... 81/124.4
4,774,736 10/1988 Brawner et al. ..... 81/124.4

FOREIGN PATENT DOCUMENTS 0448379 5/1948 Canada ..... 81/124.4
0358666 10/1931 United Kingdom ..... 81/124.4
0544751 4/1942 United Kingdom ..... 81/124.6

*Primary Examiner*—Bruce M. Kisliuk
*Assistant Examiner*—Lawrence Cruz
*Attorney, Agent, or Firm*—Browdy and Neimark

[57] ABSTRACT

The present invention relates to a hand tool with combination of independent functions, which is simple in construction and easy to manufacture. The hand tool has a tubular body with a pair of hexical joints formed integrally at both ends, to which a pair of connecting blocks or heads are mounted. The connecting blocks has a plurality of through holes, of hexical shape, to substantially receive, as desired, screw driver bits, wrench member, etc., so that it is particularly suitable for various type and different sizes of screws. In addition, an opening is formed at substantial middle portion of the tubular body to receive a spoon member which is designed for adjusting a bicycle spokes.

4 Claims, 3 Drawing Sheets

MULTI-PURPOSE HAND TOOL

FIELD OF THE INVENTION

The present invention is related to multi-purpose hand tool, particularly to the type which has connecting blocks which are suitable for screws and with additional attachments, for various application.

BACKGROUND OF THE INVENTION

While it has been proposed a hand tool such as screw driver, or wrench, which performs a single task or limited function. However, it is desirable to have a multi-purpose hand tool which is simple in construction and cheap to manufacture.

SUMMARY OF THE INVENTION

A multi-purpose hand tool utilizes a tubular body connected with a pair of hexical joints at two ends, whereas each of the hexical joints is engageable to a plurality of wrench members, screw driver bits and other accessaries for various applications.

Therefore, it is an object of the present invention to provide a multi-purpose tool which u having a pair of joints suitable for connecting with wrench members, screw driver bits and other members.

It is still an object of the present invention to resolve the problems set forth.

Other objectives and advantages will be appreciated as the invention becomes better understood by reference to the following description when considered in connection with the accompanying drawings.

DETAILED DESCRIPTION OF THE PREFERRED EMBODIMENTS

Figures 1, 2:
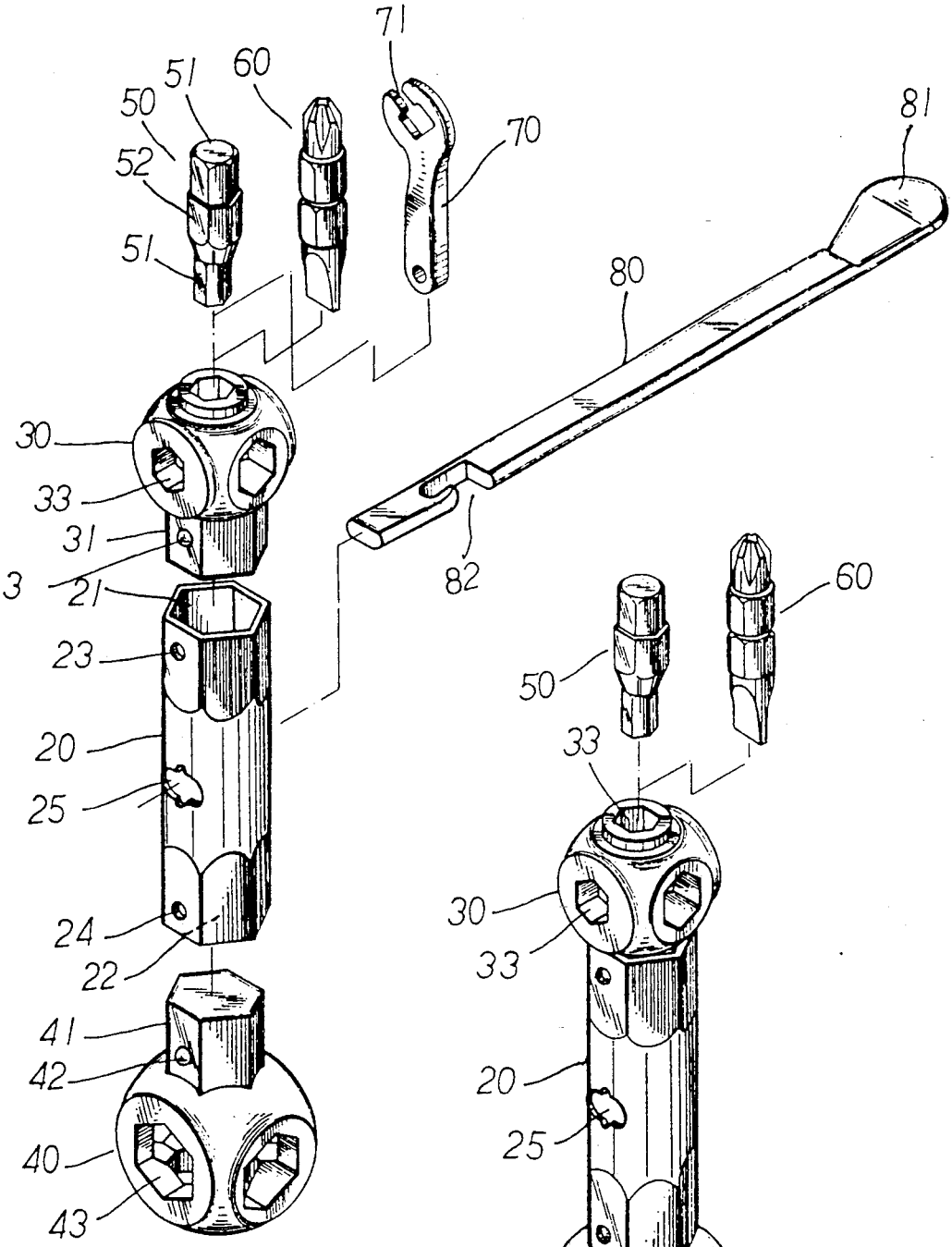
FIG. 1 is a perspective view showing the invention in separation.
FIG. 2 is an embodiment according to the present invention showing an I-shaped configuration.

With reference to FIG. 1, a multi-purpose hand tool generally has a tubular body 20, which has a pair of hexical joints 21 and 22 formed integrally on both ends. A pair of through holes 23 and 24 are respectively formed and defines on tubular wall of the joints, while an opening 25 is formed at substantial middle portion on the tubular wall of the body 20.

Figure 5:
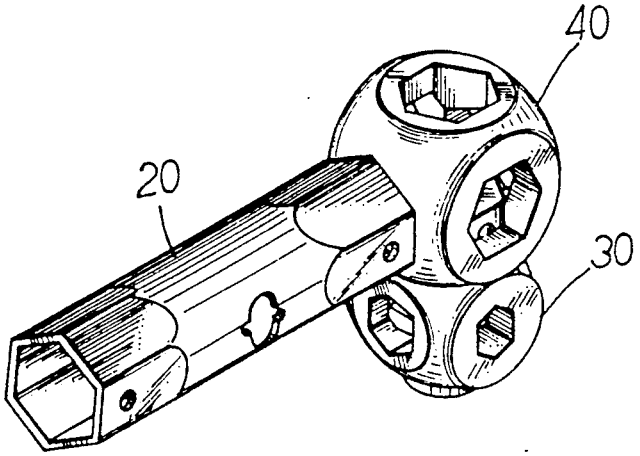
FIG. 5 is an embodiment showing a right-angle shaped configuration.

Mounted with the hexical joints 21 and 22 are connecting blocks 30 and 40, respectively. The connecting blocks are generally of spherical shapes which have connecting ends 31 and 41 insertable to the hexical joints of tubular body, whereas the connecting ends further have a pair of projections 32 and 42 to substantially engage with the through holes 23 and 24. A plurality of hexical shape openings are formed and defined on the connecting blocks in a way that allows engagement with various sizes of standard hexical screws, and thereby to fasten or unfasten bolt or nut. However, as shown in FIG. 5, the connecting blocks are inter-engageable for ease of applying forces on the screws.

Further with reference to drawings, a hexical bar member 50 has two ends designated by numeral 51, which has generally different sizes and are used for inner hexical screws.

It is noted that the hexical member has a middle portion 52 having diameter which is bigger than the ends 51, so that the insertion will be stopped by and seated on the middle portion.

FIG. 2 shows the insertion of hexical bar member 50 and further a screw driver bit 50 provided with cross-type end and flat-type end. The screw driver bit is received in hexical holes 33 of the connecting block. However, it is clarified that the size of the hexical holes is varied according to international standard, such as ISO, and the location or arrangement of holes on the connecting block is exchangeable to meet special needs in actual practice.

Figure 6:
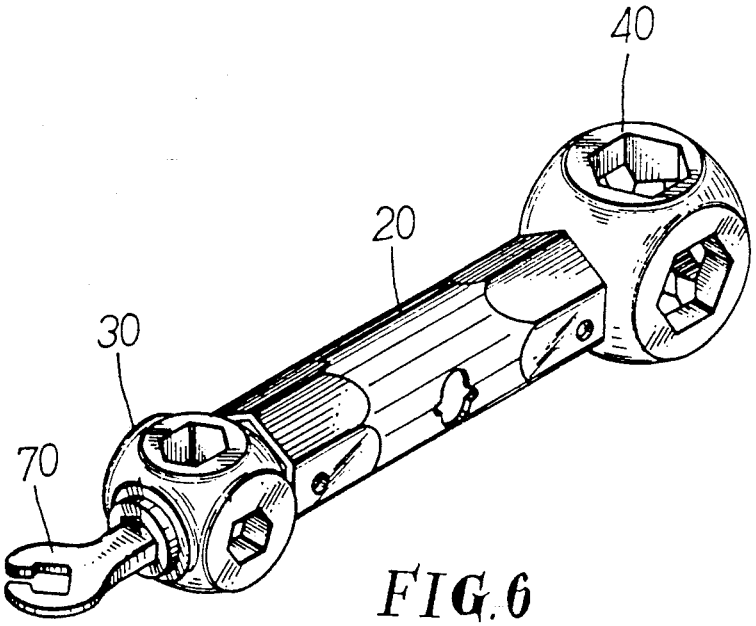
FIG. 6 shows the uses of wrench member as to adjust the connection of spokes to the hub and the rim of a bicycle.

The wrench member 70 in FIGS. 1 and 6, which is insertable with the hexical hole at one end, while it has another end of a wrench portion 71 adapted to substantially adjust the connection of spokes to the bicycle hub and rim.

Figure 3:
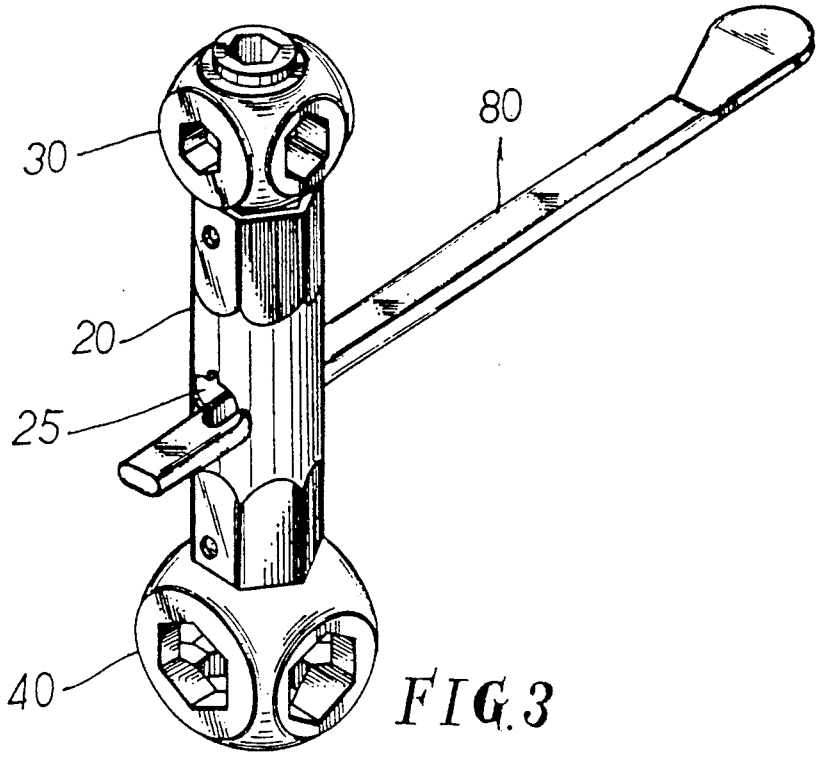
FIG. 3 is another embodiment showing a T-shaped configuration.
Figure 4:
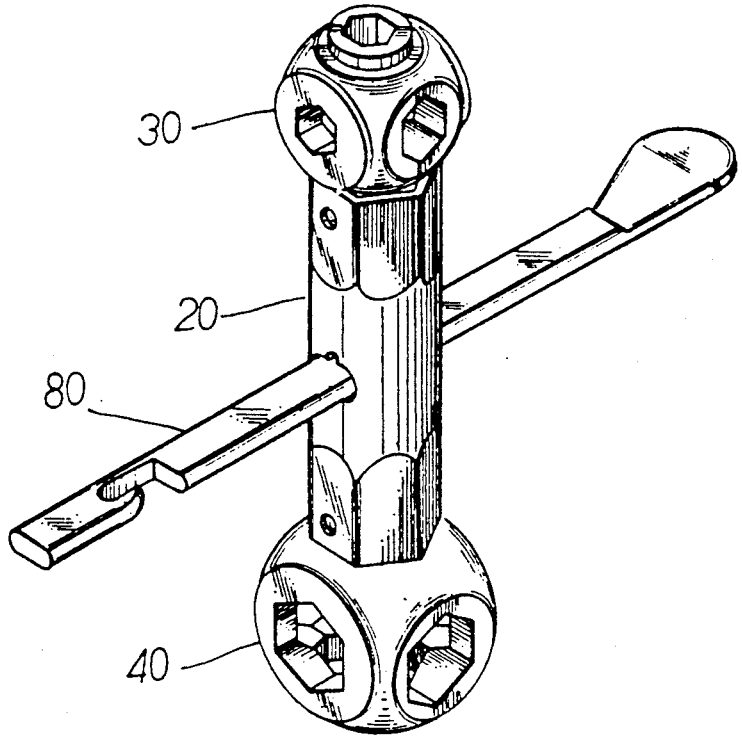
FIG. 4 is still another embodiment showing the cross-type configuration.

Turning now to FIGS. 3 and 4, a spoon-shaped member 80, generally being slim bar, has a flat-extended spoon head 81 at one end.

The spoon-shaped member 80 inserted through the opening 25 of tubular body 20, which further has connecting slot 82 formed and defined on the other end of the other end of the spoon-shaped member 80 functioning as a stop to facilitate the operation of adjusting the spokes of a bicycle.

The preferred embodiments of the present invention has been described herein and shown in the accompanying drawings to illustrate the underlying principle of the invention, but it is to be understood that numerous modifications may be made without departing from the spirit and scope of this invention.

What is claimed is:

1. A multi-purpose hand tool, comprising:

a tubular body, having a pair of joints formed integrally on both ends, an opening defined on tubular wall of said tubular body;

a pair of connecting blocks, each connected to said joints of said tubular body at one side, having a plurality of openings of different sizes defined on said connecting blocks in a way that allows engagement with various sizes of screw heads, thereby to fasten or unfasten the screws;

a plurality of tool members, each having one end being engageable to said opening of said connecting blocks;

a spoon-shaped member, of a slim bar-like member having a flat, extended spoon head formed integrally at one end provided with a connecting slot formed on the other end of said spoon-shaped member functioning as a stop to facilitate the operation of adjusting the spokes of a bicycle.

2. A multi-purpose hand tool as defined in claim 1, wherein said tool members are screw driver bits of flat-shaped or cross-type.

3. A multi-purpose hand tool as defined in claim 1, wherein said joints of said tubular body is hexical shape.

4. A multi-purpose hand tool as defined in claim 1, wherein said joints of said tubular body, each further has a through hole to substantially receive a protrusion formed integrally on said receiving side of said tubular body, so that the connection therebetween can be assured.

* * * * *